US005488965A

United States Patent [19]

Hori

[11] Patent Number: 5,488,965

[45] Date of Patent: Feb. 6, 1996

[54] WASHING NOZZLE UTILIZED IN DISHWASHING MACHINE

[75] Inventor: Fumiyuki Hori, Toyota, Japan

[73] Assignee: Hoshizaki Denki Kabushiki Kaisha, Japan

[21] Appl. No.: 166,924

[22] Filed: Dec. 14, 1993

[30] Foreign Application Priority Data

Dec. 17, 1992 [JP] Japan ..... 4-355612

[51] Int. Cl.[6] ..... A47L 15/23

[52] U.S. Cl. ..... 134/180; 134/179; 239/DIG. 1; 239/251

[58] Field of Search ..... 134/176, 179, 134/180, 181, 144, 148; 239/DIG. 1, 251

[56] References Cited

U.S. PATENT DOCUMENTS

| | | | |
|---|---|---|---|
| 2,905,393 | 9/1959 | Federighi et al. | 239/251 X |
| 3,180,348 | 4/1965 | Clearman | 134/176 |
| 3,292,645 | 12/1966 | Braden et al. | 134/176 X |
| 4,146,405 | 3/1979 | Timmer et al. | 134/176 X |
| 4,174,723 | 11/1979 | Long | 134/176 X |
| 5,006,767 | 4/1991 | Maruyama et al. | 318/103 |
| 5,017,852 | 5/1991 | Nagata et al. | 318/727 |

FOREIGN PATENT DOCUMENTS

| | | | |
|---|---|---|---|
| 3-103067 | 10/1991 | Japan . | |
| 907556 | 10/1962 | United Kingdom | 134/176 |

*Primary Examiner*—Philip R. Coe
*Attorney, Agent, or Firm*—Parkhurst, Wendel & Rossi

[57] ABSTRACT

Disclosed is a washing nozzle by which tableware 5 positioned at blind spots in a rack 6 can be effectively washed without disturbing the tableware. In the washing nozzle A, a support part 22 is formed at a central position of the washing nozzle A and arm portions 23 are formed on both sides of the support part 22. Extended portions 24 are formed at each end of the arm portions 23. Further, jetting holes 29A having substantially the same size as those of jetting nozzles 27, 28 opened on the arm portions 23 are dispersedly opened over each entire area of the extended portions 24. Thereby, a quantity of the wash water jetted from the jetting holes 29A to the tableware 5 can be totally increased, while the jetting force of the wash water jetted from the jetting holes 29A does not become so strong. Therefore, the wash water can be uniformly jetted to the tableware 5 set in four corners of the rack 6 without occurrence the blind spots, and wash unevenness can be avoided. Further, it can prevent the tableware 5 from being upset and disturbed in the rack 6 by the wash water jetted from the jetting holes 29A on the extended portions 24.

8 Claims, 10 Drawing Sheets

WASHING NOZZLE UTILIZED IN DISHWASHING MACHINE

BACKGROUND OF THE INVENTION

1. Field of the Invention

The present invention relates to a washing nozzle with jetting holes for jetting jet streams of wash water to tableware set in a washing chamber of a dishwashing machine while being rotated. In particular it relates to a washing nozzle through which the wash water can be widely jetted to the tableware positioned at four corners of a rack for setting tableware therein, thereby the tableware can be efficiently washed.

2. Description of Related Art

Conventionally, have been proposed various washing nozzles utilized in a dishwashing machine. Such washing nozzles are classified in two types according to washing manner. One is a fixed type and the other is a rotating type.

Here, the fixed type is constructed from a washing nozzle which is fixedly arranged in a wash chamber, wash water is jetted from jetting holes formed in the washing nozzle to tableware set in a rack, thereby the tableware is washed. The rotating type is constructed from a washing nozzle which washes the tableware set in the rack by jetting the wash water to the tableware while being rotated, the washing nozzle being rotated by horizontal component force of reactive jetting force yielded when the wash water is jetted from the jetting holes.

In the fixed type, since the washing nozzle is fixed in the wash chamber, are degraded jetting force and jetting angle of the wash water are degraded due to shape of the tableware to be washed (for instance, in case that the tableware has a shape of bowl), unless an arranging position of the washing nozzle or forming positions of the jetting holes in the washing nozzle is suitably decided. And similarly, maintenance of the dishwashing machine such as change of a filter arranged in a wash water tank cannot be easily conducted since the washing nozzle is fixed in the wash chamber. Thus, running cost cannot be reduced in the dishwashing machine utilizing the washing nozzle of the fixed type.

On the other hand, the rotating type is widely used in the various dishwashing machines based on a reason that the rotating washing nozzle washes the tableware by jetting the wash water from the jetting holes to the tableware while rotating and the above mentioned problems in the fixed type scarcely occurs. For example, as such rotating washing nozzle, a washing nozzle shown in FIGS. 8, 9 is conventionally utilized in the dishwashing machine.

Here, the conventional rotating washing nozzle will be described hereinafter referring to FIGS. 8 and 9. FIG. 8 is a plan view of the washing nozzle and FIG. 9 is a side view of the washing nozzle, in which a part of the nozzle is sectioned.

A rotating washing nozzle 50 is constructed from a pair of nozzle members 51 (upper nozzle member) and 52 (lower nozzle member), each of the nozzle members 51, 52 being pressed into a predetermined shape as shown in FIGS. 8, 9 and combined into one body by calking. A support part 53 is formed on a central position of the washing nozzle 50 and this support part 53 is rotatably supported at an end portion of a pipe (not shown) for providing wash water to the washing nozzle 50, thereby the washing nozzle 50 becomes rotatable at the end portion of the pipe.

On the upper surface of the upper nozzle member 51, a plurality of evaginated portions 54 are formed (for example, eight of the evaginated parts 54 are formed in FIGS. 8 and 9). And a pair of jetting holes 55 are opened on each of the evaginated parts 54. Further, among four evaginated parts 56 formed near the support part 53, on each of two evaginated parts 56 being opposed with each other, a jetting hole 57 is opened, respectively.

In the above washing nozzle 50, when the wash water is provided with the washing nozzle 50 from the pipe for providing the wash water, the wash water is jetted to the dirty tableware set in the rack (not shown) from the jetting holes 55, 57 and the dirty tableware is washed. At that time,, the washing nozzle 50 is rotated around the support part 53 by the horizontal component force of the reactive jetting force yielded when the wash water is jetted from the jetting holes 55, 57 and the washing nozzle 50 washes the tableware while rotating thereof.

However, in the dishwashing machine adopting the rotating washing nozzle 50 mentioned above, the wash water is jetted to the tableware set in the Pack from the jetting holes 55, 57 while the washing nozzle 50 is rotated and therefore, blind spots (where the wash water is not jetted) are, in general, apt to occur at four corners in the rack. As a result, there is a problem that the tableware set at the four corners in the rack cannot be effectively washed. Further, in the washing nozzle 50, jettable range of the wash water jetted from the jetting holes 55 opened on the evaginated parts 54 formed on both ends of the washing nozzle 50, is very narrow as shown by arrows in FIG. 10. Thus, it will be possible that the tableware set at the four corners in the rack cannot be effectively washed.

In order to avoid the above problems, the large jetting holes 55 which cover wide jetting area are opened on the evaginated parts 54 at both ends of the washing nozzle 50 and thereby the tableware set at the four corners (blind spots) in the rack are washed.

However, in that case, plenty of the wash water is jetted from the jetting holes 55. Therefore, for instance, in case that such washing nozzle 50 is utilized as the lower nozzle in the wash chamber, the tableware such as cups in the rack, which are formed of synthesized polymer and thus comparatively light, will be upset due to the tableware being lifted by strong jetting force of the wash water jetted from the large jetting holes 55. If the tableware is upset, the wash water is gathered in the tableware and, as a result, the tableware cannot be effectively washed. In addition to the above, rinsing of the washed tableware cannot be effectively conducted if the tableware is upset. Further, when the tableware is disturbed by the strong force of the jetted wash water from the jetting holes 55, the tableware is collided with each other and thus broken.

SUMMARY OF THE INVENTION

Accordingly, it is an object of the present invention to overcome the above mentioned problems and to provide a washing nozzle utilized in a dishwashing machine through which tableware positioned at blind spots in a rack can be effectively washed without disturbing the tableware.

In order to accomplish the above object, the present invention provides a washing nozzle utilized in a dishwashing machine including a wash chamber, a rack arranged in the wash chamber for setting tableware therein, a pair of washing nozzles, each having a plurality of jetting holes for jetting wash water to the tableware in the rack and being arranged apart from the rack by a predetermined distance and a providing means for providing the wash water with the washing nozzles, the dishwashing machine washing the tableware by jetting the wash water provided from the providing means to the tableware through the jetting holes while rotating the washing nozzles, wherein a plurality of evaginated portions are formed on a side opposing to the rack at both ends of the washing nozzle and the jetting hole is opened on each of the evaginated portions.

In the present invention constructed above, when the tableware set in the rack arranged in the wash chamber are washed, the wash water is provided with the washing nozzles from the providing means. The provided wash water is jetted from the jetting holes in the washing nozzles to the tableware and thereby the washing nozzles are rotated by horizontal component force of reactive jetting force yielded when the wash water is jetted from the jetting holes. Thereby, the washing nozzles wash the tableware to jet the wash water to the tableware from the jetting holes thereof while being rotated.

At that time, since a plurality of evaginated portions are formed on the side opposing to the rack at both ends of the washing nozzle and the jetting hole is opened on each of the evaginated portions, the wash water from the jetting holes is effectively jetted over four corners of the rack and thus the tableware set at the four corners of the rack can be effectively washed.

The above and further objects and novel features of the invention will more fully appear from the following detailed description when the same is read in connection with the accompanying drawings. It is to be expressly understood, however, that the drawings are for purpose of illustration only and not intended as a definition of the limits of the invention.

BRIEF DESCRIPTION OF THE DRAWINGS

The invention will be described with references to the following drawings, wherein.

DETAILED DESCRIPTION OF THE PREFERRED EMBODIMENTS

Figure 1:
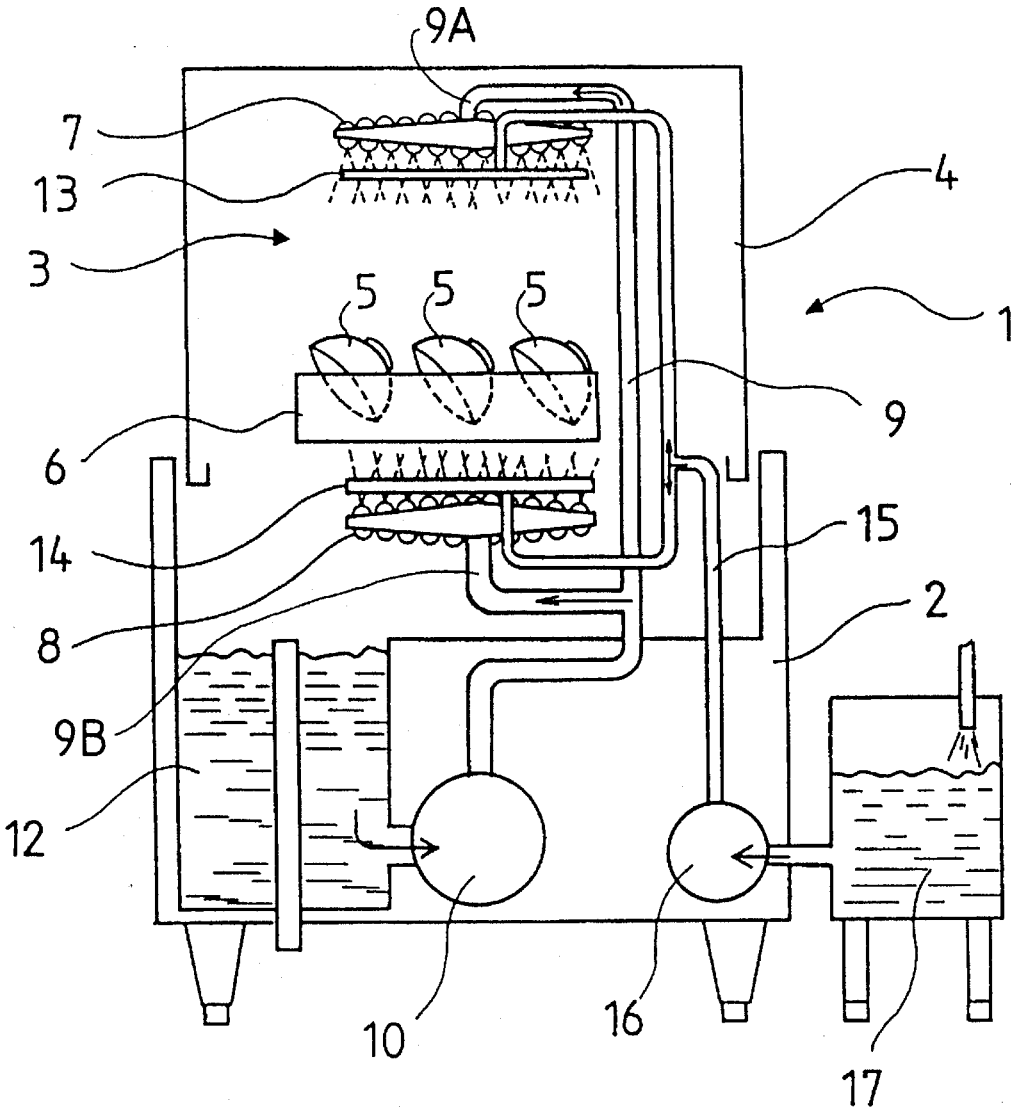
FIG. 1 is a side sectional view schematically showing a dishwashing machine.

A detailed description of the first and the second preferred embodiments of a washing nozzle embodying the present invention will now be given referring to the accompanying drawings.

At first, a dishwashing machine in which the washing nozzles of both the first and the second embodiments are utilized will be described referring to FIG. 1.A dishwashing machine 1 is essentially constructed from a base 2 and a cover hood 4 forming a wash chamber 3. The cover hood 4 is arranged to the base 2 so that the cover hood 4 becomes movable toward both the upper direction and the lower direction through a well known mechanism for moving the cover hood 4 to up and down directions. And through such mechanism, the cover hood 4 is moved to the upper direction when dirty tableware 5 is set in the wash chamber 3 and the tableware 5 is taken out of the wash chamber 3 after washed, and on the other hand, the cover hood 4 is moved to the lower direction (see FIG. 1) when washing of the tableware 5 is started.

In the wash chamber 3, a rack 6 for setting the tableware 5 therein is arranged. The rack 6 has many spaces therein so that wash water jetted from washing nozzles 7, 8 can pass from the upper direction and vice versa therethrough.

A pair of washing nozzles 7, 8, each of which has the same construction (later mentioned), are respectively arranged at the upper and the lower positions apart from the rack 6 by a predetermined distance. Each of the washing nozzles 7, 8 is rotatably installed at support ends 9A, 9B of a pipe 9 for providing the wash water and is rotated around the support end 9A, 9B through horizontal component force of reactive jetting force yielded when the wash water is jetted from plural jetting holes opened in the washing nozzles 7, 8. And these washing nozzles 7, 8 are communicated to a wash pump 10 installed on the base 2, through the pipe 9. Further, a wash water tank 12 for storing the wash water is arranged in the base 2 and the wash water tank 12 is communicated to the wash pump 10. Thereby, in case that the tableware 5 in the rack 6 is washed, the wash water in the wash water tank 12 is provided with the washing nozzles 7, 8 through the pipe 9 by the wash pump 10 and the wash water is jetted from the jetting holes opened in the washing nozzles 7, 8 to the tableware 5. As a result, the tableware is washed.

A pair of rinse nozzles 13, 14, in each of which a plurality of jetting holes are formed, are arranged near each of the washing nozzles 7, 8 and are communicated to a rinse pump 18 through a pipe 15 for providing rinse water. A rinse water tank 17 for storing rinse water therein, which is communicated to the rinse pump 18, is arranged out of the base 2. According to the above construction, when the tableware 5 after being washed is rinsed, the rinse pump 18 is driven and the rinse water in the rinse water tank 17 is provided with the rinse nozzles 13, 14 through the pipe 15. The rinse water provided with the rinse nozzles 13, 14 is jetted from the jetting holes to the tableware 5 in the rack 6 , thereby rinsing of the tableware 5 is conducted.

Next, a washing nozzle A of the first embodiment, which is utilizable as the mentioned washing nozzles 7, 8 will be described referring to FIGS. 2–4, hereinafter. Here, the above mentioned washing nozzles 7, 8 utilized in the dishwashing machine 1 has the same construction with each other and the washing nozzle A of the first embodiment will be utilizable as each of the washing nozzles 7, 8.

Figure 2:
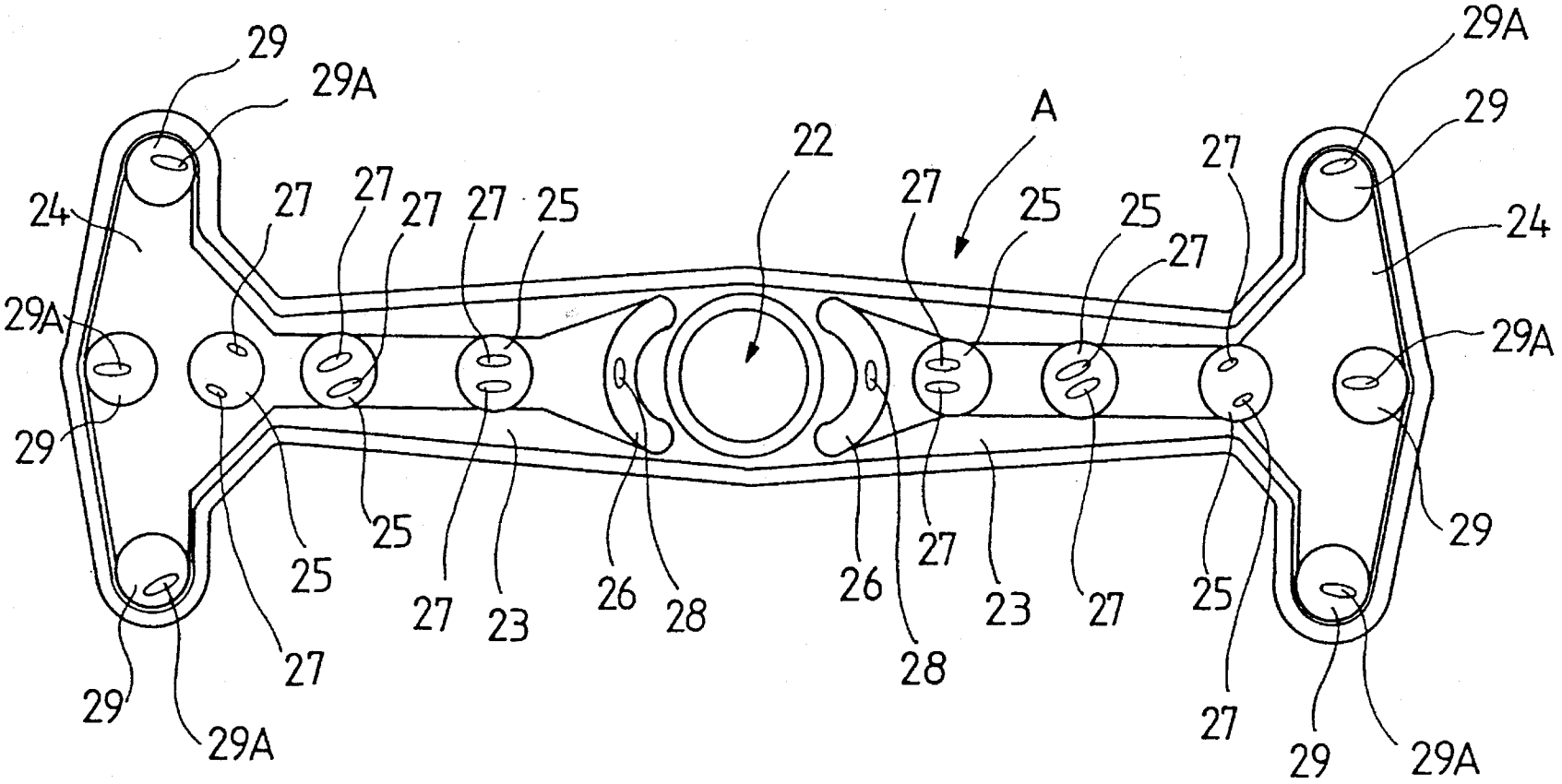
FIG. 2 is a plan view of a washing nozzle according to the first embodiment.
Figure 3:
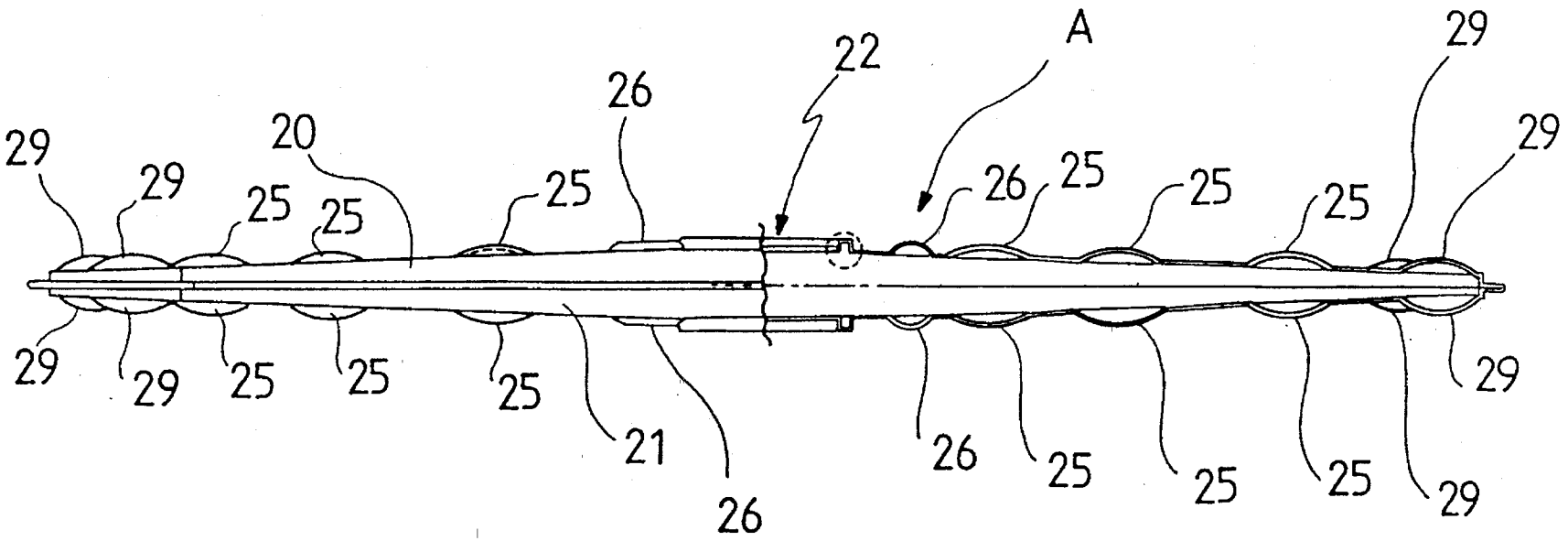
FIG. 3 is a side view of a washing nozzle, in which a part of the nozzle is sectioned, according to the first embodiment.

In FIGS. 2 and 3, the washing nozzle A is constructed by combining a pair of nozzle members 20, 21 (the upper nozzle member 20 and the lower nozzle member 21, each of which has the same shape) through caulking thereof. Here, each of the nozzle members 20, 21 is formed by that a metallic plate is, at first, drawn to form the nozzle members 20, 21 by using the same drawing die and thereafter evaginated parts 25, 26 and 29 later mentioned) and jetting holes 27, 28 and 29 A (later mentioned) are formed in the one nozzle member 20 when each of the nozzle members 20, 21 is cut separately.

At a central position of the washing nozzle A, a support part 22 for rotatably supporting the washing nozzle is formed. The support part 22 is installed at each of the support ends 9A and 9B of the pipe 9 as mentioned above. Thus, each of the washing nozzles A is rotatably supported to the pipe 9. And at both sides of the support part 22, arm portions 23 are formed as shown in FIG. 2 and an extended portion 24 extends from each end part of the arm portions 23 so as to cross the arm portion 23. This extended portion 24 is shaped so that the shape thereof substantially coincides with an arc described when the washing nozzle A is rotated around the support part 22 and further is shaped as substantial "T" in cooperation with the arm portion 23.

On each of the arm portions 23 of the nozzle member 20 in the washing nozzle A, the nozzle member 20 being opposed to the rack 6 and becoming the lower nozzle member if the washing nozzle A is used as the upper washing nozzle and the upper nozzle member if the washing nozzle A is used as the lower washing nozzle), three hemispherical evaginated portions 25 are formed. Two arc evaginated portions 26 are formed near the support part 22 on the arm portions 23.

Further, on each evaginated portion 25, a pair of parallel jetting holes 27 are opened at a position out of the center position of the evaginated portion 25. On each of evaginated portions 26, a jetting hole 28 is opened. Here, the jetting holes 27 are opened at the position out of center position of the hemispherical evaginated portion 25 so that the washing nozzle A can be effectively rotated by making large the reactive jetting force yielded when the wash water is jetted from the jetting holes 27.

On each of the extended portions 24, three hemispherical evaginated portions 29 are dispersedly formed and on each of the evaginated portions 29, a jetting hole 29A is opened, respectively. Here, each of the jetting holes 29A is arranged at a position distant from the support part 22 with substantially same distance. This means that each of the jetting holes 29A is positioned on the arc described by the holes 29A when the washing nozzle A is rotated around the support part 22. Thus, each of the jetting holes 29A is dispersedly formed on the extended portion 24 in three directions from the support part 22, as shown in FIG. 2. On each of the evaginated portions 29 in each of the extended portions 24, a jetting hole 29A is opened at a position out of the center position of the evaginated portion 29. Thereby, the wash water jetted from each of the jetting holes 29A is dispersed in three directions as shown in FIG. 4. Here, size of each jetting hole 29A is substantially same as that, of the jetting holes 27, 28 opened on the evaginated portions 25, 26, respectively. Therefore, jetting force caused by the wash water jetted from the jetting holes 29A does not specially become so strong.

Operation of the dishwashing machine 1 in which the above constructed washing nozzle A of the first embodiment is utilized will be described hereinafter. First, the cover hood 4 is moved upward and the tableware 5 to be washed is set in the rack 6. Thereafter, the cover hood 4 is moved downward. And when a switch of the dishwashing machine 1 (not shown) is turned on, the wash pump 10 is driven. The wash water stored in the wash water tank 12 is provided to each of the washing nozzles A (the upper washing nozzle and the lower washing nozzle) through the pipe 9 by the driven wash pump 10. The wash water is jetted to the tableware 5 in the rack 6, from the jetting holes 27 opened on the hemispherical evaginated portions 25 formed on the arm portions 23, the jetting holes 28 opened on the evaginated portions 26, and the jetting holes 29A opened on the hemispherical evaginated portions 29 formed on the extended portions 24. While the wash water is jetting, the washing nozzles A is rotated at the support ends 9A, 9B of the pipe 9 around the support part 22 by the horizontal component force of the reactive jetting force yielded when the wash water is jetted from the jetting holes 27, 28 and 29A.

At that time, since the jetting holes 29A, each size being substantially same as that of the jetting holes 27, 28 opened on the arm portions 23, are dispersed on entire area of the extended portions 24, a quantity of the wash water jetted from the jetting holes 29A at the both ends of the washing nozzle A to the tableware 5 can be totally increased and, on the other hand, the jetting force of the wash water jetted from the jetting holes 29A does not become so strong. Therefore, the blind spots do not occur at the four corners of the rack 6 and as a result, the wash water can be uniformly jetted to the tableware 5 located at the four corners of the rack 6 and it can prevent the tableware 5 from being upset and disturbed in the rack 6 by the wash water jetted from the jetting holes 29A on the extended portions 24 of the lower washing nozzle A.

Figure 4:
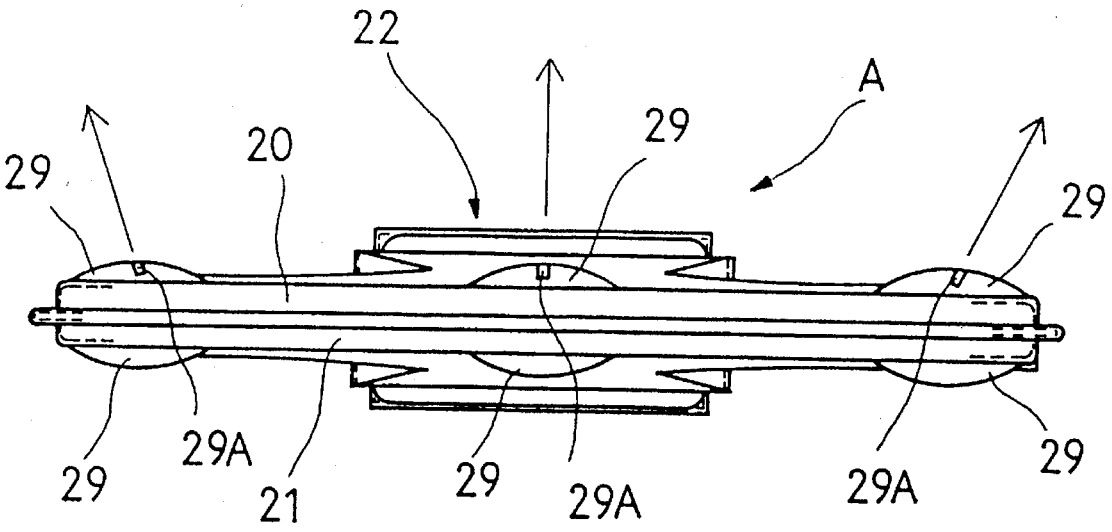
FIG. 4 is a schematic sectional view to explain a state in which wash water is jetted from jetting holes opened on extended portions of a washing nozzle, according to the first embodiment.

In addition to the jetting holes 29A being dispersedly opened over the extended portions 24, since the wash water is dispersedly jetted in three directions from the jetting holes 29A as shown in FIG. 4, the wash water can also be effectively jetted to the tableware 5 set at the four corners of the rack 6.

Further, since the wash water is jetted from the jetting holes 29A of the upper washing nozzle A to the tableware 5 (in this case, the wash water is jetted to outer surfaces of the tableware 5 as shown in FIG. 1), the jetting force of the wash water jetted from the jetting holes 29A acts to each of the tableware pieces so that the tableware 5 is pressed from the outer surfaces thereof, thereby it can prevent the tableware 5 from being upset.

After washing process of the tableware 5 mentioned above is conducted for a predetermined time (counted by a timer, not shown), a rinse process follows. During the rinse process, the rinse pump 16 is driven and the rinse water stored in the rinse water tank 17 is provided with the rinse nozzles 13, 14 through the pipe 15. The rinse process is conducted for a predetermined time which is counted by a timer (not shown). After the rinse process is conducted, wash operation of the tableware 5 set in the rack 6 is finished. Thereafter, the cover hood 4 is moved upward and the washed tableware 5 is taken out of the wash chamber 3.

As mentioned above, in the washing nozzle A according to the first embodiment, the arm portions 23 are formed on both sides of the support part 22 and the extended portions 24 are formed at each end of the arm portions 23. Further, the jetting nozzles 29A with the substantial same size as those of the jetting nozzles 27, 28 opened on the arm portions 23 are dispersedly opened over each entire area of the extended portions 24. Thereby, quantity of the wash water jetted from the jetting holes 29A to the tableware 5 can be totally increased and on the other hand, the jetting force of the wash water jetted from the jetting holes 29A does not become so strong.

Therefore, the wash water can be uniformly jetted to the tableware 5 set in the four corners of the rack 6 without occurrence the blind spots therein, and wash unevenness can be avoided. Further, it can prevent the tableware 5 from being upset and disturbed in the rack 6 by the wash water jetted from the jetting holes 29A on the extended portions 24 of the lower washing nozzle A.

In addition to the jetting holes 29A being dispersedly opened over the extended portions 24, since the wash water is dispersedly jetted in three directions from the jetting holes 29A as shown in FIG. 4, the wash water can also be effectively jetted to the tableware 5 set at the four corners of the rack 6.

Further, since the wash water is jetted from the jetting holes 29A of the upper washing nozzle A to the tableware 5 (in this case, the wash water is jetted to outer surfaces of the tableware 5 as shown in FIG. 1), the jetting force of the wash water jetted from the jetting holes 29A acts to each of the tableware 5 so that the tableware 5 is pressed from the outer surfaces thereof, thereby preventing the tableware 5 from being upset.

Since the washing nozzle A is constructed by combining a pair of the nozzle members 20, 21, each of the nozzle members 20, 21 having the same shape with each other, through calking, a common drawing die to produce each of the nozzle members 20, 21 can be utilized therefore, cost for producing the washing nozzle A can be extremely reduced.

Next, a washing nozzle B of the second embodiment, which is utilizable as the mentioned washing nozzles 7, 8 will be described referring to FIGS. 5–7, hereinafter. Here, the above mentioned washing nozzles 7, 8 utilized in the dishwashing machine 1 has the same construction with each other and the washing nozzle B of the second embodiment will be utilizable as each of the washing nozzles 7, 8.

Figure 5:
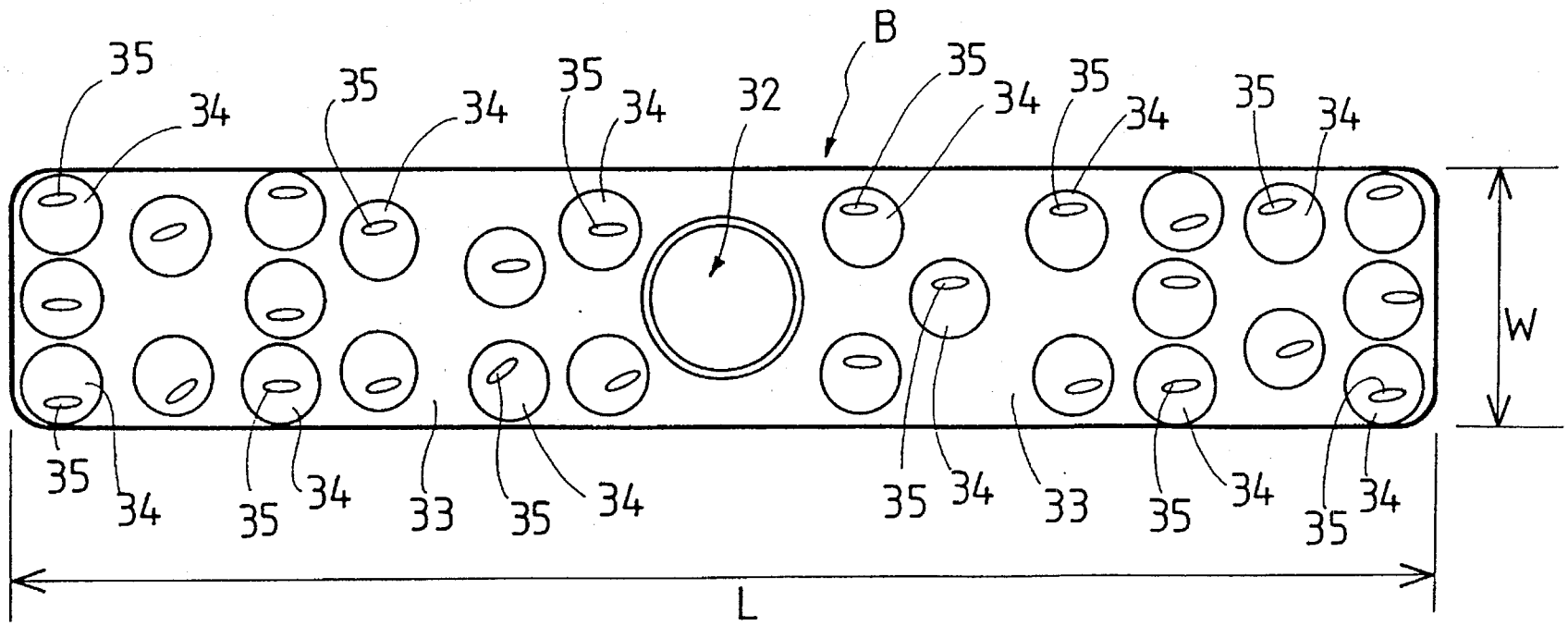
FIG. 5 is a plan view of a washing nozzle according to the second embodiment.
Figure 6:
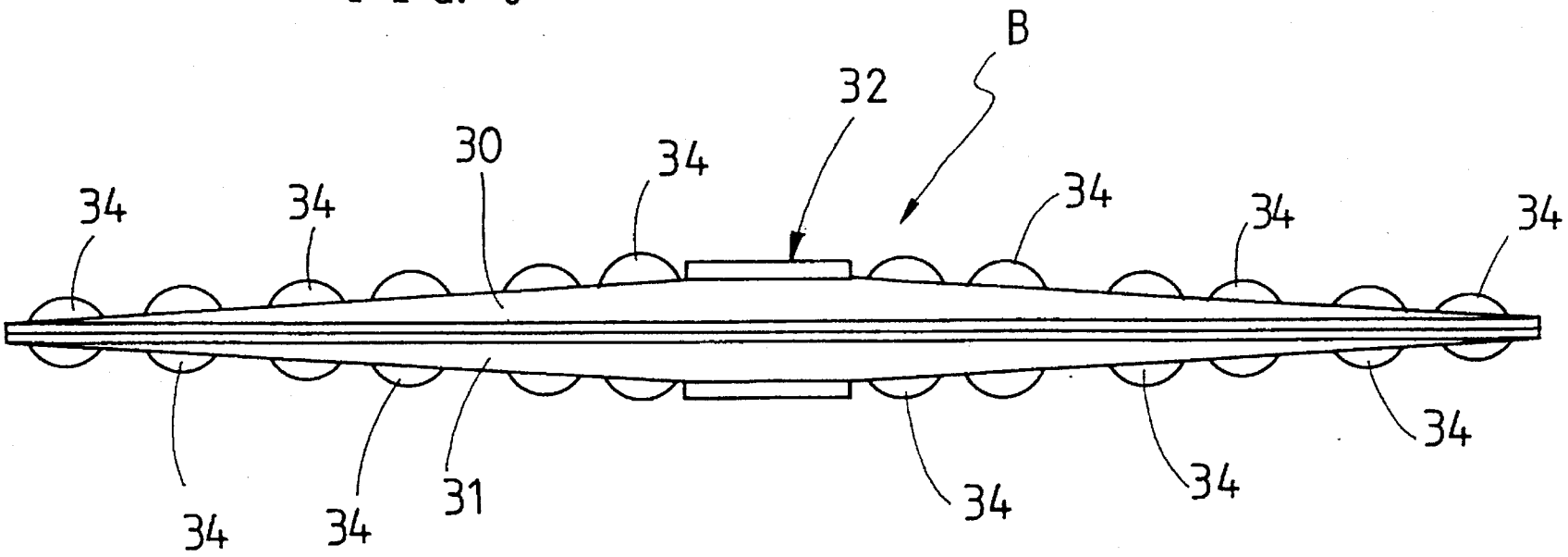
FIG. 6 is a side view of a washing nozzle according to the second embodiment.

In FIGS. 5 and 6, the washing nozzle B is constructed by combining a pair of nozzle members 30, 31 (the upper nozzle member 30 and the lower nozzle member 31, each of which has the same shape) through caulking thereof. Here, each of the nozzle members 30, 31 is formed according that a metallic plate is, at first, drawn to form the nozzle members 30, 31 by using the same drawing die and thereafter evaginated parts 34 (later mentioned and jetting holes 35 (later mentioned) are formed in the one nozzle member 30 when each of the nozzle members 30, 31 is cut separately. Each of the nozzle member 30, 31 is shaped rectangular having a predetermined width W and a predetermined length L as shown in FIG. 5. Thus, as mentioned later, it will be possible that comparatively many of hemispherical evaginated portions 34 and jetting holes 35 are formed on the nozzle member 30.

At a central position of the washing nozzle B, a support part 32 for rotatably supporting the washing nozzle is formed and the support part 32 is installed at each of the support ends 9A and 9B of the pipe 9 as mentioned above. Thus, each of the washing nozzles B is rotatably supported to the pipe 9. On both sides of the support part 32, arm portions 33 are formed as shown in FIG. 5. On each of the arm portions 33, the hemispherical evaginated portions 34 are formed over a plurality of rows (in FIG. 5, six rows are formed on both sides of the support part 32) along with a direction of the width W.

Here, in FIG. 5, on the arm portion 33 at the left side of tile support part 32, the evaginated portions 34 are formed in the first through the sixth row from the support part 32 toward the end of the washing nozzle B. In the first through the third row, two evaginated portions 34 are formed and in the fourth row, three evaginated portions 34 are formed. Further, in the fifth row, two evaginated portions 34 are formed and in the sixth row existing at end of the nozzle member 30, three evaginated portions 34 are formed. On each of the evaginated portions 34, one jetting hole 35 is opened at a position out of the center position of the evaginated portion 34. Regarding this point, each of the jetting holes 34 are opened at the position out of the center position of the hemispherical evaginated portion 35 so that the washing nozzle B can be effectively rotated by making large the reactive jetting force yielded when the wash water is jetted from the jetting holes 34.

Similarly, on the arm portion 33 at the right side of the support part 32, the evaginated portions 34 are formed in the first through the sixth row from the support part 32 toward the end of the washing nozzle B. In the first row, two evaginated portions 34 are formed, and in the second row, one evaginated portion 34 is formed. Further, in the third row, two evaginated portions 34 are formed, and in the fourth row, three evaginated portions 34 are formed. In the fifth row, two evaginated portions 34 are formed, and in the sixth row existing at end of the nozzle member 30, three evaginated portions 34 are formed. On each of the evaginated portions 34, one jetting hole 35 is opened at a position out of the center position of the evaginated portion 34. Similarly regarding this point, each of the jetting holes 34 are opened at the position out of the center position of the hemispherical evaginated portion 35 so that the washing nozzle B can be effectively rotated by making large the reactive jetting force yielded when the wash water is jetted from the jetting holes 34.

The nozzle member 30 on which the hemispherical evaginated portions 34, each having the jetting hole 35, is utilized in the washing nozzle B as a nozzle member opposing to the rack 6. Thus, the nozzle member 30 is utilized as the lower nozzle member if the washing nozzle B is used as the upper washing nozzle, and is utilized as the upper nozzle member if the washing nozzle B is used as the lower washing nozzle.

At that point, in case that the tableware 5 set in the rack 6 arranged in the wash chamber 3 are washed by using the washing nozzle B, in order to uniformly wash the tableware 5 without both occurring the blind spots in the four corners of the rack 6 and disturbing the tableware 5, it is a very important how the wash water jetted from the jetting holes 35 opened on the three evaginated portions 34 at the both ends (existing in the sixth rows on the arm portions 33) of the washing nozzle B acts on the tableware 5. Taking into consideration such action by the wash water, it is necessary to adjust the wash water so that the wash water jetted from the jetting holes 35 of the evaginated portions 34 located at the both ends of the washing nozzle B is uniformly jetted over a wide range and jetting force of the wash water does not become unnecessarily strong so as to obtain a suitable jetting force.

At the above point, in the washing nozzle B of the second embodiment, three hemispherical evaginated portions 34 are dispersedly formed at the both ends of the nozzle member 30 in the direction of the width W and the jetting hole 35 having same size as that in the other evaginated portion 34 is opened on each evaginated portion 34 at the position out of the center position of the evaginated portion 34. Thereby, the jetting force jetted from each of the jetting hole 35 becomes comparatively small and the jetting direction of the wash water is dispersed in three directions as shown in FIG. 7. As a result, the wash water from the jetting holes 35 with a suitable force can be jetted over the wide range to the directions toward the four corners of the rack 6. Therefore the tableware 5 located at the four corners of the rack 6 can be effectively washed without being upset and disturbed in the rack 6.

Operation of the dishwashing machine 1 in which the above constructed washing nozzle B of the second embodiment is utilized will be described hereinafter. First, the cover hood 4 is moved upward and the tableware 5 to be washed is set in the rack 6. Thereafter, the cover hood 4 is moved downward. When a switch of the dishwashing machine 1 (not shown) is turned on, the wash pump 10 is driven. The wash water stored in the wash water tank 12 is provided to each of the washing nozzles B (the upper washing nozzle and the lower washing nozzle) through the pipe 9 by the driven wash pump 10. The wash water is jetted to the tableware 5 in the rack 6, from the jetting holes 35 opened on the hemispherical evaginated portions 34 formed on the arm portions 33. While the wash water are jetting, the washing nozzles B is rotated at the support ends 9A, 9B of the pipe 9 around the support part 32 by the horizontal component force of the reactive jetting force yielded when the wash water is jetted from the jetting holes 35.

Here, the jetting holes 35 with the same size are dispersedly formed over the arm portions 33 of the washing nozzle B and in particular, on both ends of the washing nozzle B, three hemispherical evaginated portions 34 are dispersedly formed in the direction of the width W and further the jetting hole 35 with the same size as that of the other hole 35 is opened on each of the evaginated portion 34 at the position out of the center position of thereof. Thereby, a quantity of the wash water jetted from the jetting holes 35 at both ends of the wash nozzle B can be totally increased. On and on the other hand, the jetting force of the wash water jetted from the jetting holes 35 does not become so strong. As a result, the wash water can be uniformly jetted to the tableware 5 located at the four corners of the rack 6 without occurrence of the blind spots and it can prevent the tableware 5 from being upset and disturbed in the rack 6 by the wash water jetted from the jetting holes 35 at both ends of the lower washing nozzle B.

Figure 7:
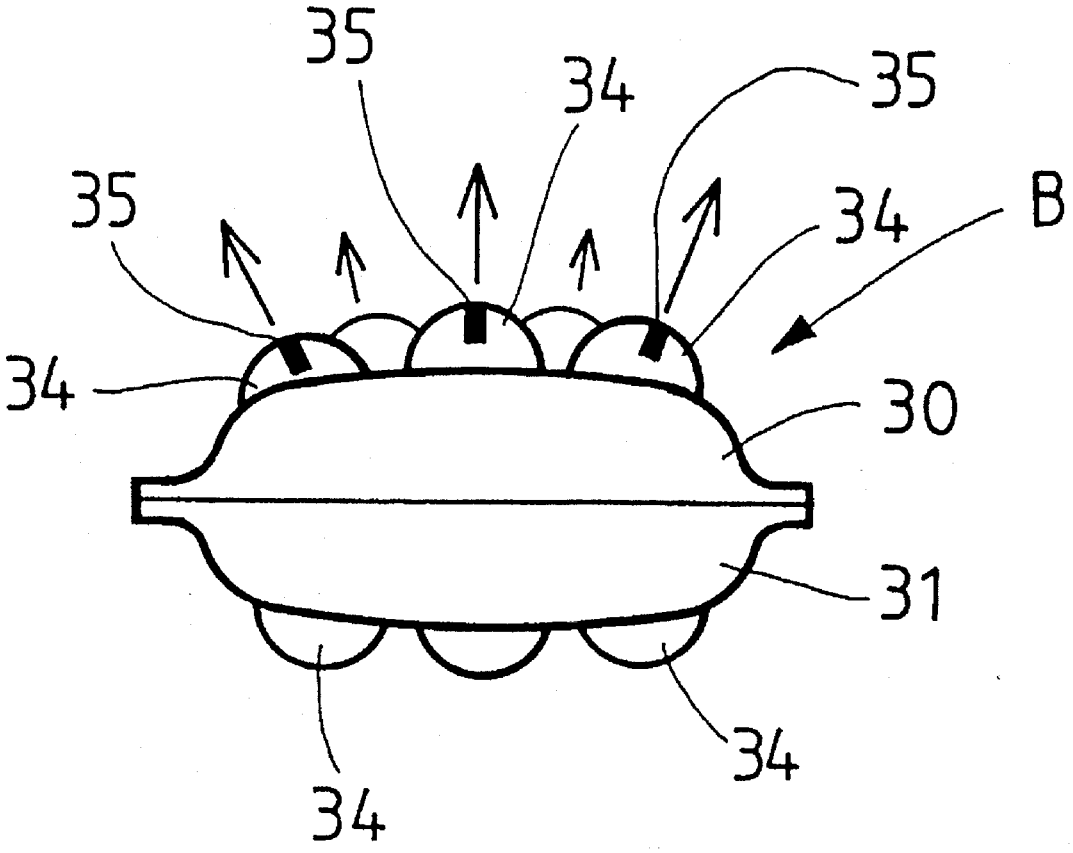
FIG. 7 is a schematic sectional view to explain a state in which wash water is jetted from jetting holes opened at both ends of a washing nozzle, according to the second embodiment.
Figure 8:
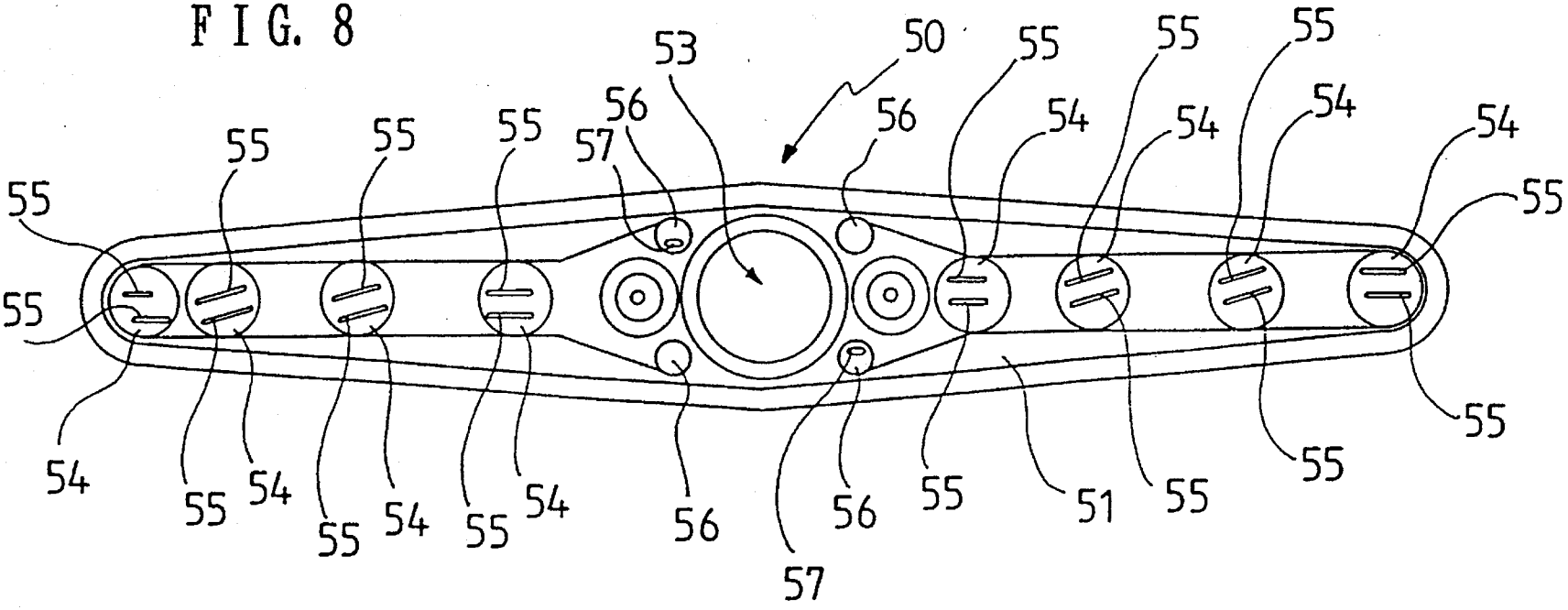
FIG. 8 PRIOR ART
FIG. 8 is a plan view of a washing nozzle utilized in a conventional dishwashing machine.
Figure 9:
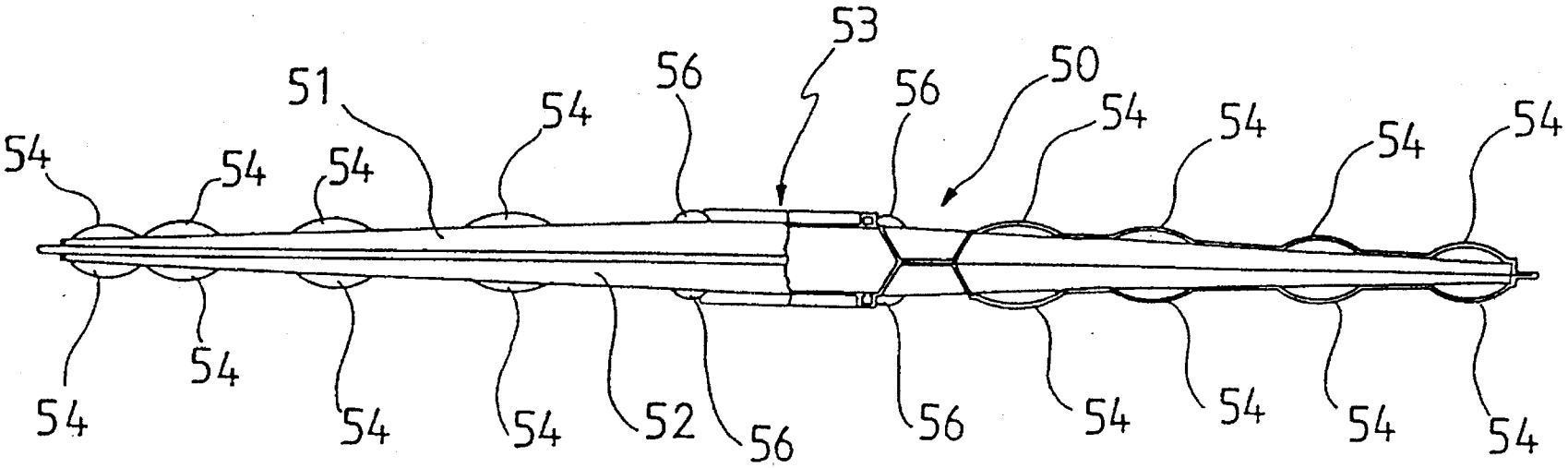
FIG. 9 PRIOR ART
FIG. 9 is a side view of a conventional washing nozzle, in which a part of the nozzle is sectioned.
Figure 10:
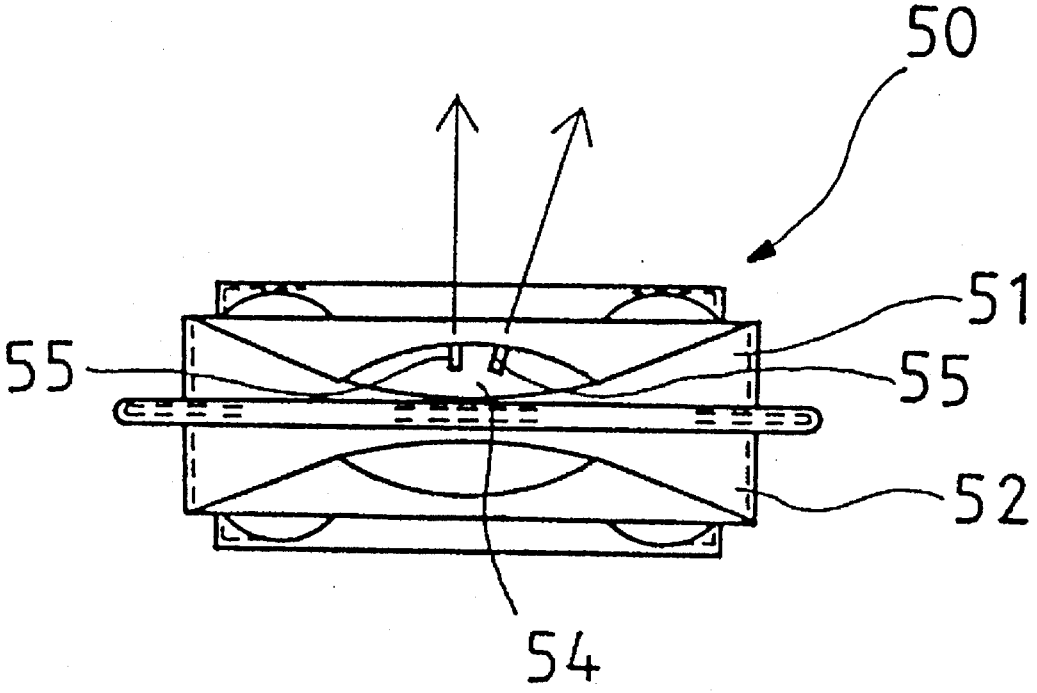
FIG. 10 PRIOR ART
FIG. 10 is a schematic sectional view to explain a state in which wash water is jetted from jetting holes opened at both ends of a washing nozzle utilized in a conventional dishwashing machine.

In addition to the jetting holes 35 being dispersedly opened over the arm portions 33 in the direction of the width W, since the wash water is dispersedly jetted in three directions from the jetting holes 35 as shown in FIG. 7, the wash water can also be effectively jetted to the tableware 5 set at the four corners of the rack 6.

Further, since the wash water is jetted from the jetting holes 35 of the upper washing nozzle B to the tableware 5 (in this case, the wash water is jetted to outer surfaces of the tableware 5 as shown in FIG. 1), the jetting force of the wash water jetted from the jetting holes 35 acts on each of the tableware 5 so that the tableware 5 is pressed from the outer surfaces thereof, thereby it can prevent the tableware 5 from being upset.

After washing process of the tableware 5 mentioned above is conducted for a predetermined time (counted by a timer, not shown), a rinse process follows. During the rinse process, the rinse pump 16 is driven and the rinse water stored in the rinse water tank 17 is provided with the rinse nozzles 13, 14 through the pipe 15. The rinse process is conducted for a predetermined time which is counted by a timer (not shown). After the rinse process is conducted, wash operation of the tableware 5 set in the rack 6 is finished. Thereafter, the cover hood 4 is moved upward and the washed tableware 5 is taken out of the wash chamber 3.

As mentioned above, in the washing nozzle B according to the second embodiment, the arm portions 33 are formed on both sides of the support part 32 and the jetting hole 35 having the same size as those of the other jetting holes 35 is opened on each of three hemispherical evaginated portions 34 dispersedly formed in the direction of the width W on each end of the arm portion 33. Thereby, quantity of the wash water jetted from the jetting holes 35 to the tableware 5 can be totally increased and on the other hand, the jetting force of the wash water jetted from the jetting holes 35 does not become so strong.

Therefore, the wash water can be uniformly jetted to the tableware 5 set in the four corners of the rack 6 without occurrence of blind spots, and wash unevenness can be avoided. Further, it can prevent the tableware 5 from being upset and disturbed in the rack 6 by the wash water jetted from the jetting holes 35 on both ends of the washing nozzle B.

In addition to the jetting holes 35 being dispersedly opened over both ends of the washing nozzle B, since the wash water is dispersedly jetted in three directions from the jetting holes 29A as shown in FIG. 7, the wash water can also be effectively jetted to the tableware 5 set at the four corners of the rack 6.

Further, since the wash water is jetted from the jetting holes 35 of the upper washing nozzle B to the tableware 5 (in this case, the wash water is jetted to outer surfaces of the tableware 5 as shown in FIG. 1), the jetting force of the wash water jetted from the jetting holes 35 acts on each of the tableware 5 so that the tableware 5 is pressed from the outer surfaces thereof, thereby it can prevent the tableware 5 from being upset.

Since the washing nozzle B is constructed by combining a pair of the nozzle members 30, 31, each of the nozzle members 30, 31 having the same shape, through caulking, a common drawing die to produce each of the nozzle members 30, 31 can be utilized. Therefore, cost for producing the washing nozzle B can be extremely reduced. While the invention has been particularly shown and described with reference to preferred embodiments thereof, it will be understood by those skilled in the art that the foregoing and other changes in form and details can be made therein without departing from the spirit and scope of the invention.

What is claimed is:

1. A washing nozzle for a dishwashing machine which includes a wash chamber and a rack for setting tableware therein, said washing nozzle comprising:

a generally elongate nozzle member having first and second arms extending from a central portion of the nozzle member, said first and second arms terminating by respective first and second transverse extensions which extend along directions transverse to the first and second arms; and a plurality of evaginated portions formed along the first and second arms and the first and second transverse extensions, on one of opposite major surfaces of the nozzle member, each of the evaginated portions having a jetting hole through which wash water is jetted.

2. The washing nozzle of claim 1, wherein the evaginated portions are hemispherical.

3. The washing nozzle of claim 2, wherein the jetting holes are respectively provided off-center on the evaginated portions.

4. The washing nozzle of claim 1, further comprising a support part provided at the central portion of the nozzle member for rotatably supporting the nozzle member along an axis of rotation.

5. The washing nozzle of claim 4, wherein the first and second transverse extensions extend along an arc of a circle which is concentric with the axis of rotation.

6. The washing nozzle of claim 4, wherein a distance between the axis of rotation and each of the jetting holes of the evaginated portions provided on the first and second transverse extensions is the same.

7. The washing nozzle of claim 1, wherein the evaginated portions are spaced apart along the first and second transverse extensions along said directions transverse to the first and second arms.

8. The washing nozzle of claim 1, wherein the size of the jetting holes is the same.

* * * * *